United States Patent [19]

Gallusser et al.

[11] Patent Number: 4,907,981

[45] Date of Patent: Mar. 13, 1990

[54] QUICK-RELEASE ELECTRICAL CONNECTOR COUPLING DEVICE

[75] Inventors: David O. Gallusser, Oneonta; Gene L. Snyder, Bainbridge, both of N.Y.

[73] Assignee: Amphenol Corporation, Wallingford, Conn.

[21] Appl. No.: 271,286

[22] Filed: Nov. 15, 1988

[51] Int. Cl.[4] ..... H01R 13/625

[52] U.S. Cl. ..... 439/258

[58] Field of Search ..... 439/256–265

[56] References Cited

U.S. PATENT DOCUMENTS

| | | | |
|---|---|---|---|
| 2,660,456 | 11/1953 | Meddock | 284/18 |
| 3,458,850 | 7/1969 | Calisher | 339/45 |
| 3,888,559 | 6/1975 | Geib | 339/46 |
| 4,390,222 | 6/1983 | Carter | 439/258 |
| 4,421,373 | 12/1983 | Ratchford | 339/94 |
| 4,433,889 | 2/1984 | Ratchford et al. | 439/258 |
| 4,605,271 | 8/1986 | Burns | 339/45 |
| 4,620,760 | 11/1986 | Duncan | 339/45 |
| 4,717,351 | 1/1988 | McCormick | 439/153 |

FOREIGN PATENT DOCUMENTS 1464746 1/1967 France .

*Primary Examiner*—Joseph H. McGlynn
*Attorney, Agent, or Firm*—Bacon & Thomas

[57] ABSTRACT

An electrical coupling assembly is disclosed having a receptacle portion attached to an electrical connector element and releasably attached to a housing, affixed to the opposite electrical connector portion, by engagement of a latching ball on the housing with a latching detent formed on the receptacle. Axial movement of an operating sleeve, with respect to the housing facilitates the coupling and decoupling of the housing and the receptacle. The operating sleeve is spring biased to assume a position with respect to the housing retaining the coupling portions together. A force exerted on a lanyard attached to the sleeve axially moves the sleeve with respect to the housing to decouple the coupling elements. A lanyard guide ring is attached to the housing and has an opening through which the lanyard passes such that the portion of the lanyard extending between the guide ring and the operating sleeve extends in a generally axial direction. The direction of force exerted on the sleeve by the lanyard will always be in a substantially axial direction. The coupling includes a mechanism for disengaging the electrical connector portions before allowing the coupling elements to separate.

15 Claims, 5 Drawing Sheets

QUICK-RELEASE ELECTRICAL CONNECTOR COUPLING DEVICE

BACKGROUND OF THE INVENTION

The present invention relates to an electrical connector coupling device for releasably coupling electrical connector portions. More particularly, the invention relates to such an electrical coupling device having a lanyard operated quick release mechanism.

Coupling devices of the quick-disconnect type are well known in the art and typically comprise a first portion affixed to one of the electrical connector elements and a second portion affixed to the opposite, mating electrical connector element. The connector elements are retained in mating engagement by interengaging latching means formed on the coupling portions. It is known to latch the coupling portions together by the engagement of a latching ball, retained on one of the coupling portions, with a detent formed in the opposite coupling portion. Typically, the latching means are retained in engagement by an axially slidable sleeve affixed to one of the coupling portions. In one of its positions, the sleeve prevents radially outward movement of the latching ball so as to retain it in the locking detent. Movement of the sleeve in an axial direction usually aligns a recessed portion with the ball so as to permit it to move radially outwardly, thereby disengaging the locking detent, thereby enabling the two portions to be separated.

It is also known to impart a releasing movement to the axially slidable sleeve by attaching a lanyard to the sleeve. Usually, a pulling force imparted to the lanyard will not only move the sleeve to its releasing position, but will also serve to disengage the mating portions of the electrical connector.

While these known coupling devices have proven generally satisfactory, problems have arisen when the force exerted on the lanyard by the user is not in an axial direction coincident with the longitudinal axis of the coupling. The exertion of such an oblique force on the sleeve may cause the sleeve to bind and fail to release the coupling portions in its intended fashion, or it may necessitate a greater exertion force on the lanyard than is normally required. This poses the obvious problem of breakage of either the lanyard or the sleeve.

Furthermore, even if the sleeve should function in its intended manner upon the application of the oblique force to the lanyard, it is possible that this oblique force will cause damage to the contact pins during the disengagement of the electrical connector portions. Typically of the known connectors, the electrical contact pins are not disengaged from their corresponding holes until the portions of the coupling assembly are disengaged from each other. Thus, any oblique force imparted to the coupling portions will also impart an oblique force to the electrical connector elements which may cause damage to the contact pins.

SUMMARY OF THE INVENTION

The present invention relates to a lanyard-operated, quick-release electrical coupling assembly. A receptacle portion attached to one of the electrical connector elements is releasably attached to a housing, affixed to the opposite electrical connector portion by engagement of a latching ball on the housing with a latching detent formed on the receptacle. An operating sleeve is mounted on the housing and defines detents which permit coupling and decoupling of the coupling assembly. Axial movement of the operating sleeve with respect to the housing facilitates the coupling of the housing and the receptacle by permitting the latching ball to move radially outwardly as the receptacle is moved axially into the housing until the latching ball engages the latching detent. The operating sleeve is spring biased to assume a position with respect to the housing which prohibits radially outward movement of the latching ball, thereby retaining it in the latching detent thereby attaching the coupling portions together.

A force exerted on the lanyard attached to the sleeve axially moves the sleeve with respect to the housing such that a decoupling detent is aligned with the latching ball, thereby permitting it to disengage from the latching detent on the receptacle and allow the decoupling of the housing and receptacle.

A lanyard guide ring is attached to the housing and has an opening through which the lanyard passes such that the portion of the lanyard extending between the guide ring and the operating sleeve extends in a generally axial direction. Thus, regardless of the direction of force exerted by the user on the lanyard, the lanyard will always exert a substantially axial force on the operating sleeve to permit its proper functioning.

The coupling device incorporates a mechanism for disengaging the electrical connector portions before the operating sleeve aligns the decoupling detent with the latching ball. This mechanism retains the coupling portions in latching relationship until the electrical connector elements have been completely disengaged. This prevents any oblique forces from being applied to the electrical connector elements so as to prevent any damage to them during the decoupling process.

DETAILED DESCRIPTION OF THE PREFERRED EMBODIMENT

Figure 1:
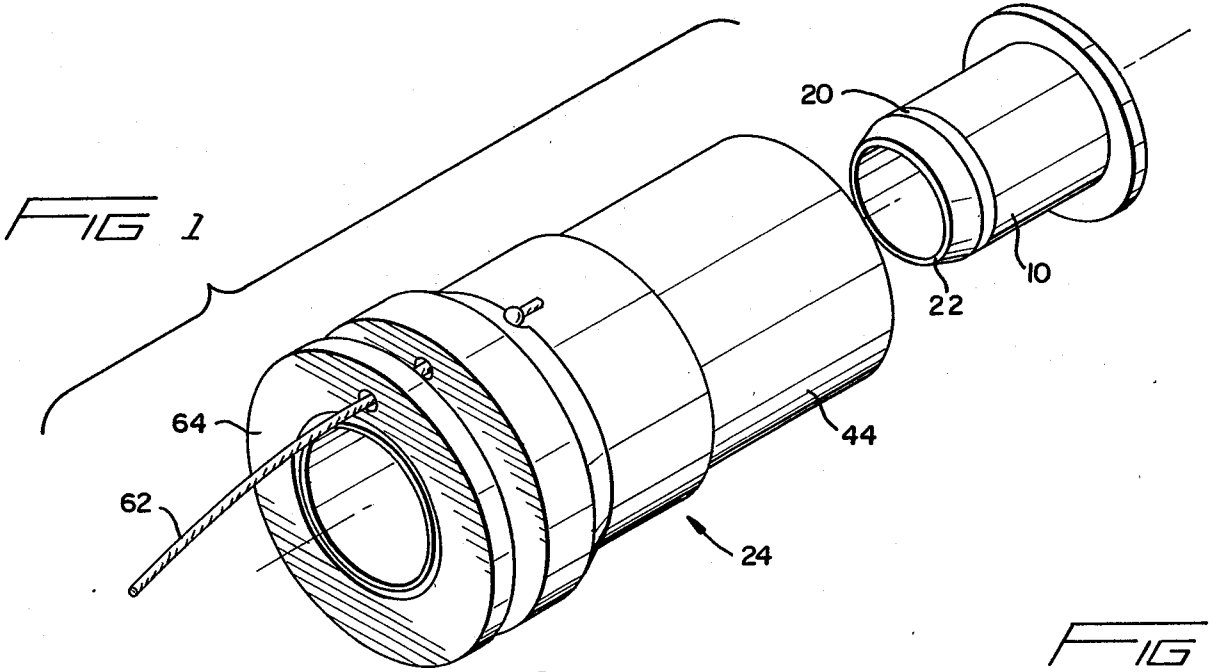
FIG. 1 is a perspective view showing the electrical coupling device according to the invention.

The coupling device according to the present invention comprises a receptacle 10 fixedly attached to electrical cable 12 by any known means. Electrical cable 12 has a first electrical connector portion 14 which may have contact pins 16 extending therefrom in a direction generally parallel to the longitudinal axis 18. Although only one such contact pin 16 is illustrated, it is to be understood that electrical connector portion 14 may have any number of such pins extending therefrom and that these pins may assume any known cross-sectional configuration. Receptacle 10 defines a latching detent groove 20 near its distal end 22. Latching detent 20 may extend around the entire circumference of the generally circular receptacle 10, or may extend only partially around the circumference, without exceeding the scope of this invention.

The mating portion of the coupling device is illustrated generally at 24 and is attached to electrical cable 26 having a connector portion 28 attached to the end thereof by any known means. Connector portion 28 defines sockets 30 corresponding in number and cross-sectional shape to that of contact pins 16 extending from electrical connector portion 14. The electrical contacts in sockets 30 are connected to individual wires in the electrical cable 26 by any known means. The precise interconnection of these elements, per se, forms no part of the instant invention and any known means may be utilized without exceeding the scope of this invention. Also, the positions of connector portions 14 and 28 may be reversed such that connector portion 28 is attached to receptacle 10 and connector portion 14 is attached to coupling portion 24 without exceeding the scope of this invention.

Coupling portion 24 has plug shell 32 attached to the end of electrical cable 26. Plug shell 32 has a generally circumferentially extending locking shoulder **32*a*** formed thereon for purposes to be hereinafter explained in more detail.

Housing member 34 is concentrically mounted about plug shell 32 so as to be movable relative to the plug shell 32 in a direction generally parallel to the longitudinal axis 18. Housing member 34 defines a generally axially facing shoulder **34*a* as well as openings to rotatably accommodate latching ball members 36. Although two such latching ball members are illustrated in the drawings, it should be understood that one or more of the latching ball members may be utilized without exceeding the scope of this invention. Ball members 36 are mounted on the housing member 34 such that a portion extends radially inwardly of the inner surface of housing member 34. As will be described in more detail hereinafter, this inwardly protruding portion of the latching ball members 36 engage the latching detent 20 of the receptacle 10 in order to attach the coupling portions together. Housing member 34 permits slight radially outward movement of the latching ball members 36 so as to facilitate engagement and disengagement with the latching detent 20**.

Decoupling spring 38 is interposed between shoulder **34*a* of the housing member 34 and a shoulder 32*b* formed on the plug shell 32. Decoupling spring 38 is a compression spring and urges the plug shell 32 and the housing member 34 in opposite, axial directions. Axial movement of the housing member 34 with respect to the plug shell 32 is limited by alignment pins 40, fixedly attached to plug shell 32 and extending generally radially outwardly through elongated slots 42 formed in the housing member 34. Alignment pins 40 are slidably received in the slots 42 so as to limit the range of axial movement between the housing member 34 and the plug shell 32**.

Operating sleeve 44 is concentrically mounted about the housing member 34 so as to be axially movable with respect to the housing member. Operating sleeve 44 defines a coupling detent 46, a decoupling detent 48 and a locking surface 50 extending between the coupling detent and the decoupling detent. The coupling detent 46 as well as the decoupling detent 48 may comprise an inwardly opening groove extending around the inner periphery of the operating sleeve 44, as illustrated, or may comprise one or more indentations formed in the inner surface of the operating sleeve 44 in circumferential alignment with each of the latching ball members 36. The locking surface 50 has a generally cylindrical configuration. Alternatively, it may comprise a flat surface extending generally parallel to the longitudinal axis 18 in circumferential alignment with each of the latching ball members 36. The radial dimension between the longitudinal axis 18 and the locking surface 50 is less than a corresponding dimension for the coupling detent 46 and the decoupling detent 48. The detents, when in axial alignment with the ball members 36 allow these latching ball members to move radially outwardly to facilitate the coupling and decoupling of the coupling portions. Locking surface 50 prevents such radially outward movement of the latching ball members which serves to retain the coupling portions in assembled relationship.

The invention also incorporates a locking means to releasably, axially lock the plug shell 32 and the housing member 34 so as to prevent relative axial movement between these elements. The locking means comprises one or more locking pins 52 extending generally radially through corresponding openings in the housing member 34. The locking pins 52 each define a surface **52*a* having a configuration generally corresponding to that of shoulder 32*a* on the plug shell 32. A wedge actuating surface 52*b* faces radially outwardly on each of the locking pins and slidably engages a corresponding wedge actuating surface 54*a* formed on actuating ring 54. Actuating ring 54 is axially biased into contact with locking pins 52 by actuating spring 56. The opposite end of actuating spring 56, which is a compression spring, bears against push ring 58. Snap rings 60 and 66, attached to operating sleeve 44 and housing member 34, respectively, serve to limit axial movement of push ring 58**.

Lanyard 62 is attached to operating sleeve 44 so to be capable of exerting an axial force thereon extending generally toward the left as illustrated in FIGS. 2 -8. Lanyard 62 extends through an opening defined by lanyard guide ring 64 which is fixedly attached to an end of housing member 34. The portion of the lanyard extending between the lanyard guide ring 64 and the operating sleeve 44 extends generally parallel to the longitudinal axis 18. Thus, the lanyard 62 can be pulled in any direction relative to a plane defined by the lanyard guide ring extending generally perpendicular to the longitudinal axis 18 without imparting any oblique forces to the operating sleeve 44. Since the lanyard portion between the lanyard guide ring 64 and the operating sleeve extends in a generally axial direction, the force imparted to the operating sleeve 44 by the lanyard 62 will also be in a generally axial direction.

Figure 3:
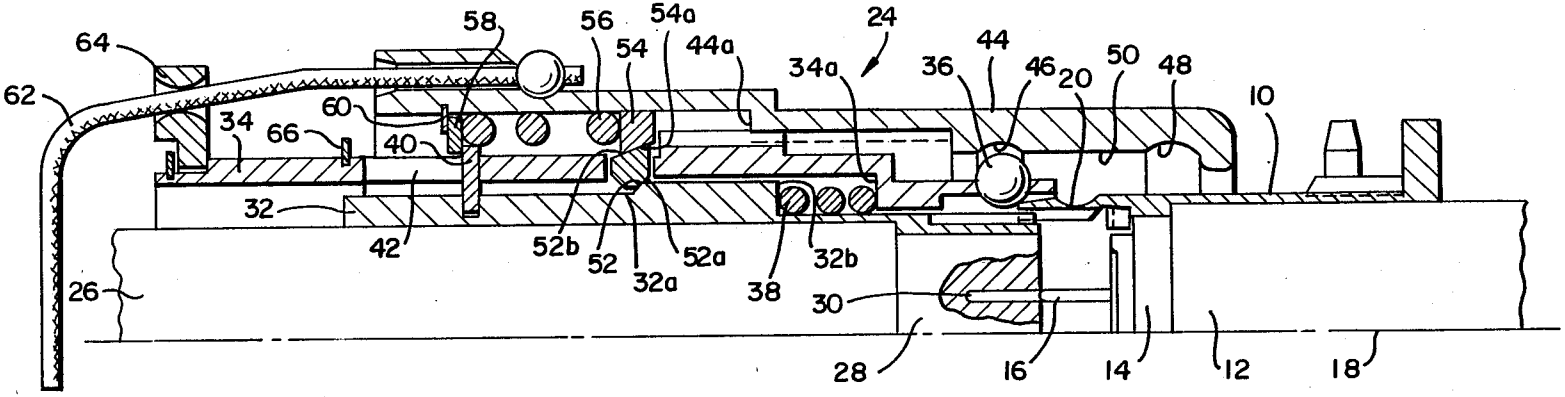
FIG. 3 is a partial, longitudinal sectional view similar to that shown in FIG. 2 showing the initial coupling positions.
Figure 2:
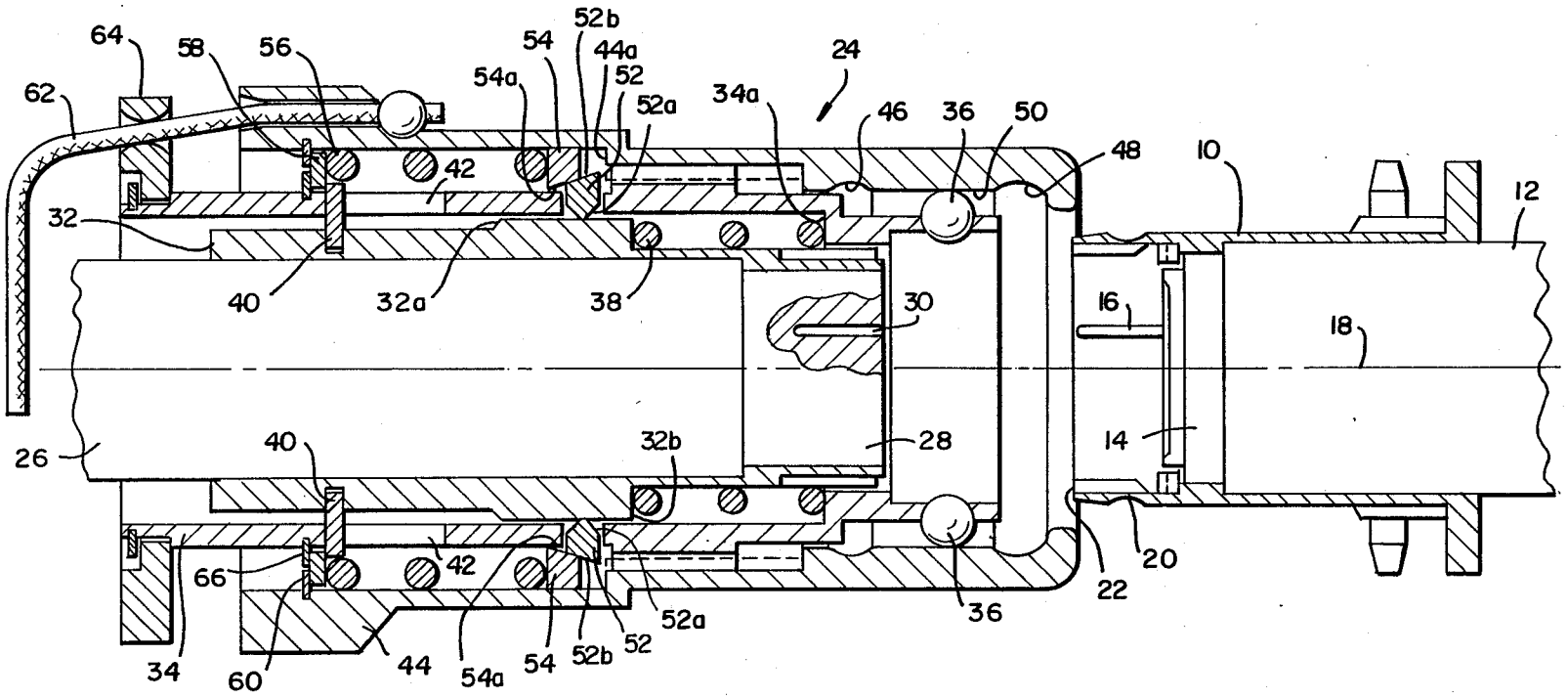
FIG. 2 is a longitudinal sectional view of the coupling device according to the present invention showing the elements in their uncoupled positions.

The coupling of the device will be described with reference to FIGS. 2, 3 and 4. The coupling device is shown in its decoupled state in FIG. 2. To connect the elements, it will be assumed that the user grasps the operating sleeve 44 to hold one end of the electrical cable and the receptacle 10 in order to hold the other. As the distal end 22 of the receptacle 10 enters the opening defined by the operating sleeve 44, its contact with the latching ball elements 36 pushes the housing member 34 toward the left as illustrated in FIG. 3. During this movement, radially outward movement of the latching ball members 36 is prohibited due to their contact with locking surface 50.

As the latching ball members 36 become axially aligned with coupling detent 46, further leftward movement of housing member 34 is prohibited by the contact between alignment pins 40 and the ends of elongated slots 42, as seen in FIG. 3. This relative movement between the housing member 34 and the plug shell 32 is such that locking pins 52 are moved to the left of shoulder 32*a*. A radially inward movement is imparted to the locking pins 52 by way of the wedge surfaces 52*b* and 54*a* due to the axial force exerted on actuating ring 54 by the compression of actuating spring 56 as housing member 34 moves to the left. This urges the locking pins 52 inwardly such that they bear against shoulder 32*a* to prevent any further axial movement between plug shell 32 and housing member 34.

At this point the latching ball members 36 are in axial alignment with coupling detent 46 and further movement of receptacle 10 brings them into alignment with latching detent 20. This additional movement also mates the electrical contact pin 16 with its corresponding contact socket 30 to fully mate the electrical connector portions.

Figure 4:
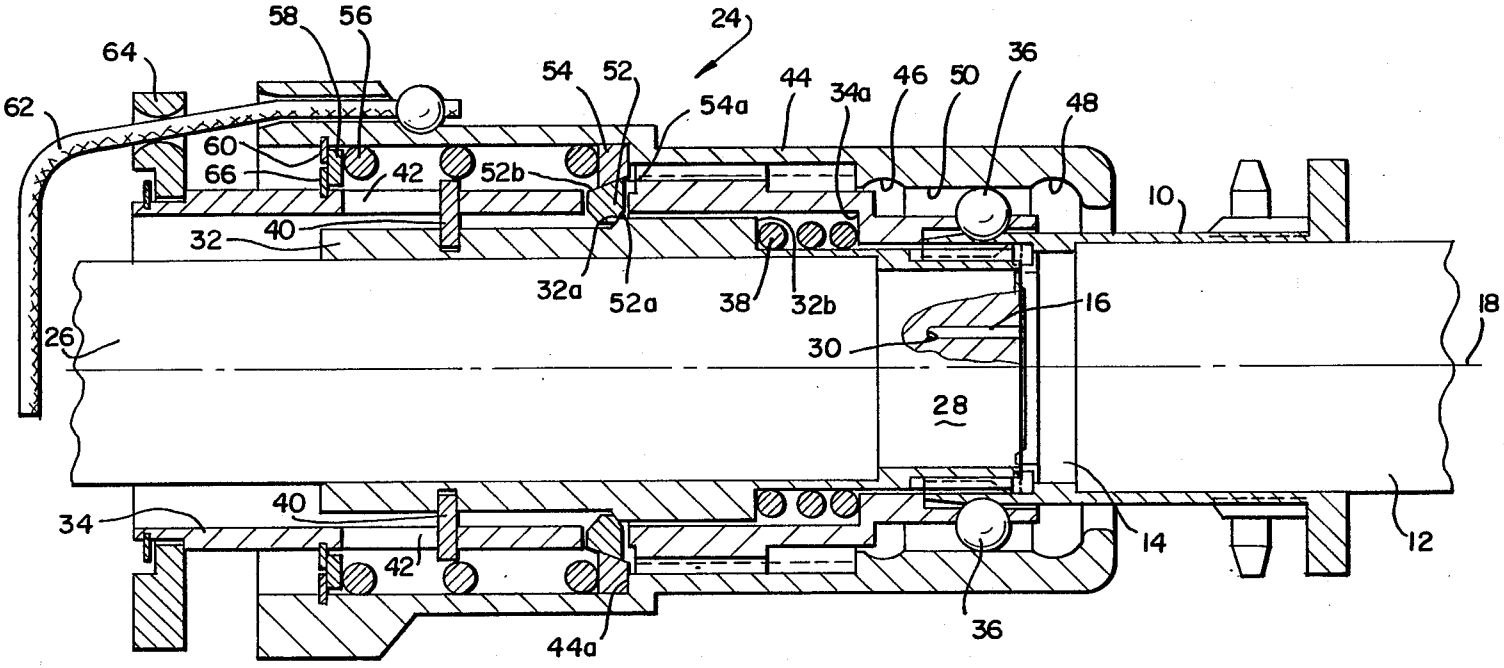
FIG. 4 is a longitudinal sectional view similar to FIG. 2 illustrating the coupling device in the fully coupled position.

By releasing the axial force exerted on operating sleeve 44, the sleeve is urged toward the left, again as seen in FIGS. 3 and 4, by compressed actuating spring 56 so as to bring the locking surface 50 into axial alignment with the latching ball members 36. Since any radially outward movement of the latching ball members 36 is now prohibited, they are retained in contact with the locking detent 20 and the coupling assembly is now in its locked position as illustrated in FIG. 4. Leftward movement of the operating sleeve 44 is limited by contact between the actuating ring 54 and shoulder 44*a* formed on operating sleeve 44.

Figure 5:
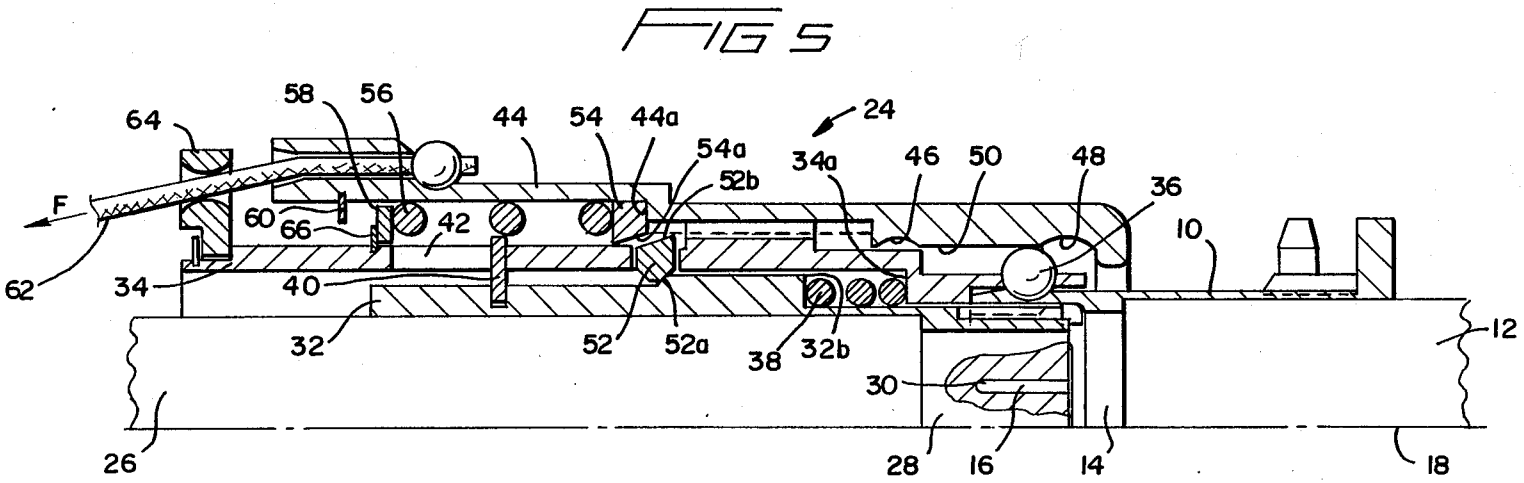
FIGS. 5 –8 are partial, longitudinal sectional views illustrating the decoupling sequence of the coupling device according to the invention.

In order to decouple the device (as illustrated in FIGS. 5 -8) and to disengage the electrical connector portions, a force F is exerted by lanyard 62 onto operating sleeve 44 urging it toward the left, as illustrated in FIG. 5. Since shoulder 44*a* is in contact with actuating ring 54, this leftward motion also serves to move the actuating ring 54 in this direction such that wedge surface 54*a* is out of contact with wedge surface 52*b* formed on locking pins 52. At this point, the latching ball members 36 have not yet reached axial alignment with decoupling detent 48.

Figure 6:
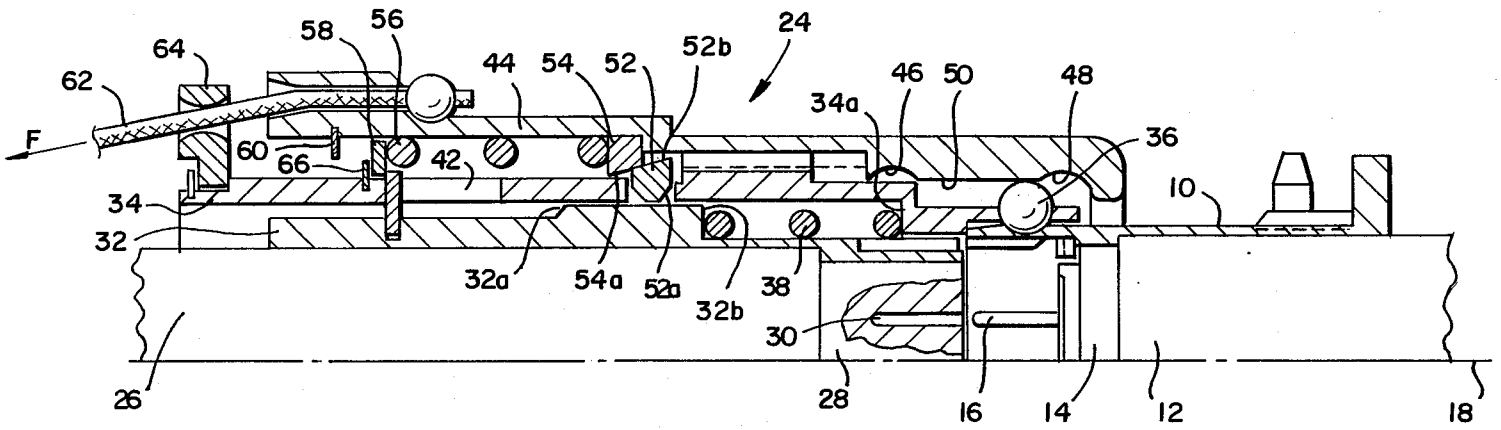
Figure 7:
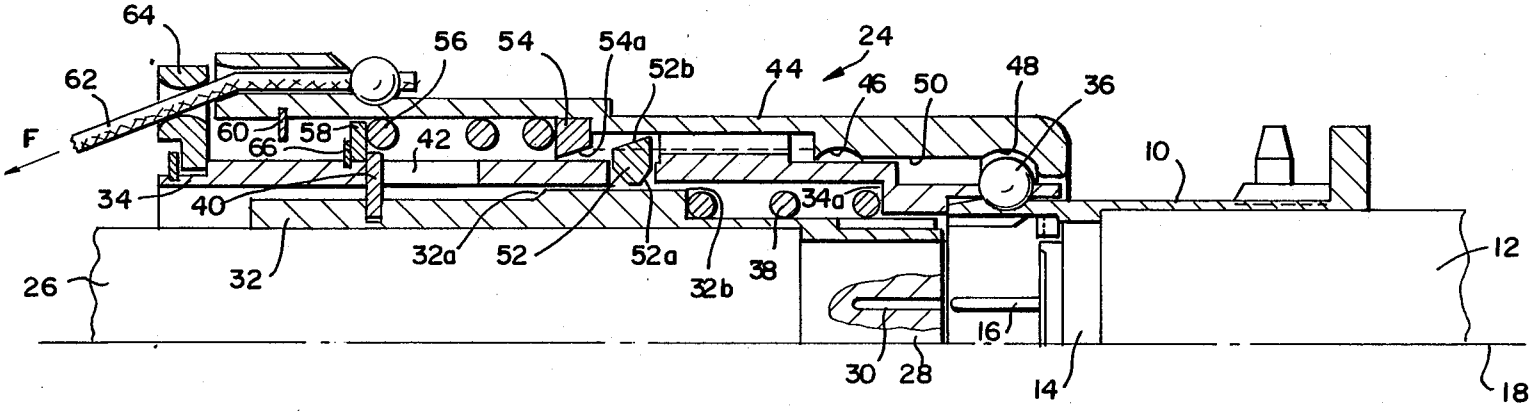
Figure 8:
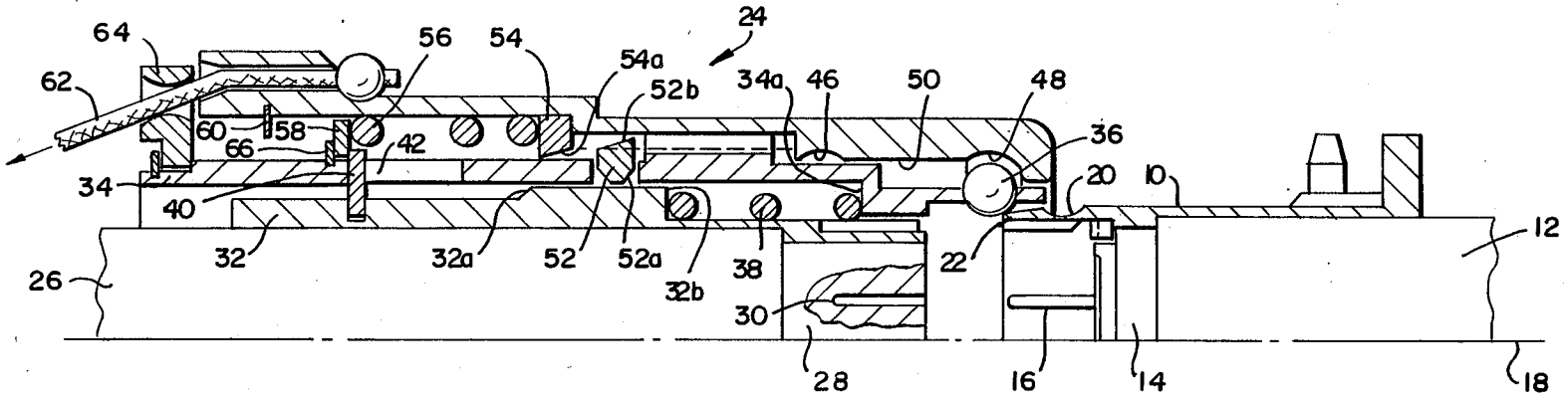

Since the force holding the locking pins 52 in their radially inward positions is no longer present, decoupling spring 38, which was compressed during the coupling operation, urges the plug shell 32 toward the left as illustrated in FIG. 6. The generally inclined shoulder 32*a* along with corresponding surface 52*a* urges the locking pins 52 radially outwardly to permit the leftward movement of the plug shell 32. Since plug shell 32 is rigidly affixed to the electrical connector portion 28, this is also urged to the left such that the contact pins 16 and the contact sockets 30 are no longer in mating engagement, as illustrated in FIG. 6. Thus, the connector according to this invention serves to disengage the electrical connector portions before the coupling device has been decoupled. This prevents any oblique force exerted on the connector assembly from being imparted to the connector pin elements which could damage the electrical connector portions. As can be seen in FIG. 6, the unmating of the electrical connector portions is achieved before the latching ball members 36 are in axial alignment with the decoupling detent 48. Further movement of the operating sleeve 44 towards the left aligns the latching ball members 36 with the decoupling detent 48, as illustrated in FIG. 7, which thereby permits the receptacle 10 to be withdrawn from the housing member and the operating sleeve 44, so as to decouple the elements, as illustrated in FIG. 8. The releasing of the force on the lanyard enables actuating spring 56, which has been compressed slightly by the relative movement between the operating sleeve 44 and the push ring 48 to move the operating sleeve toward the right to the position shown in FIG. 2. Snap ring 66, attached to housing member 34 serves to limit the movement of push ring 58 such that actuating spring 56 returns the operating sleeve 44 to its initial position. The coupling elements are then in the position shown in this figure and are ready for a subsequent coupling operation.

The foregoing description is provided for illustrative purposes only and should not be construed as in any way limiting this invention, the scope of which is defined solely by the appended claims.

What is claimed is:

1. A coupling device for releasably coupling first and second portions of an electrical connector comprising:

(a) a receptacle member attached to the first electrical connector portion;

(b) a plug shell attached to the second electrical connector portion;

(c) a housing member slidably mounted on the plug shell so as to slide in a generally axial direction;

(d) releasable latching means to latch the housing member and receptacle member together such that the electrical connector portions are in mating engagement;

(e) releasable locking means to releasably lock the housing member and the plug shell together;

(f) operating means associated with the housing member and movable between a locking position which prohibits disengagement of the latching means thereby locking the housing member and the receptacle together and the first and second electrical connector portions in mating engagement, and a release position which permits disengagement of the latching means thereby decoupling the housing member and the receptacle; and, (g) disengagement means to disengage the first and second portions of the electrical connector from mating engagement before the operating means reaches its release position.

2. The coupling device according to claim 1 wherein the releaseable latching means comprises:

(a) a latching detent defined by the receptacle member; and, (b) at least one matching ball retained on the housing member and located such that the latching ball engages the latching detent when the first and second portions of the electrical connector are in mating engagement.

3. The coupling device according to claim 2 wherein the operating means comprises an operating sleeve defining a coupling detent, a decoupling detent and a locking surface mounted on the housing member so as to be generally axially movable between a first, locking position wherein the locking surface is axially aligned and in contact with the latching ball, a second, coupling position wherein the coupling detent is axially aligned with the latching ball, and a third, release position wherein the decoupling detent is axially aligned with the latching ball.

4. The coupling device according to claim 1 wherein the releasable locking means comprises:

(a) a first shoulder formed on the plug shell;

(b) locking pin means mounted on the housing member so as to be movable between a first position wherein the locking pin means is out of contact with the first position and a second position wherein the locking pin means contacts the first shoulder; and, (c) actuating means to move the locking pin means between the first and second positions.

5. The coupling device according to claim 4, wherein the actuating means comprises:

(a) a first wedge surface formed on the locking pins means;

(b) an axially movable actuating ring having a second wedge surface adapted to contact the first wedge surface such that generally axial movement of the actuating ring with respect to the locking pin means moves the locking pin means between the first and second positions; and, (c) an actuating spring operatively associated with the actuating ring.

6. The coupling device according to claim 1 wherein the operating means comprises an operating sleeve defining a coupling detent, a decoupling detent and a locking surface mounted on the housing member so as to be generally axially movable between a first, locking position wherein the locking surface is axially aligned with the latching means, a second, coupling position wherein the coupling detent is axially aligned with the latching means, and a third, release portion wherein the decoupling detent is axially aligned with the latching means.

7. The coupling device according to claim 6 wherein the releasable locking means comprises:

(a) a first shoulder formed on the plug shell;

(b) locking pin means mounted on the housing member so as to be movable between a first position wherein the locking pin means is out of contact with the first shoulder and a second position wherein the locking pin means contacts the first shoulder; and, (c) actuating means to move the locking pin means between the first and second positions.

8. The coupling device according to claim 7 wherein the actuating means comprises:

(a) a first wedge surface formed on the locking pin means;

(b) an axially movable actuating ring having a second wedge surface adapted to contact the first wedge surface such that generally axial movement of the actuating ring with respect to the locking pin means moves the locking pin means between the first and second positions; and (c) an actuating spring interposed between the operating sleeve and the actuating ring.

9. The coupling device according to claim 8 wherein the actuating spring comprises a compression spring normally biasing the actuating ring into contact with the locking pin means and biasing the operating sleeve to its first, locking position.

10. The coupling device according to claim 9 further comprising release means to move the actuator ring axially away from the locking pin means thereby releasing the locking means between the housing member and the plug shell.

11. The coupling device according to claim 10 wherein the release means comprises a second shoulder formed on the operating sleeve located such that the locking means is released before the operating sleeve reaches its third, decoupling position.

12. The coupling device according to claim 1 wherein the disengagement means comprises spring means acting on the housing member and the plug shell to move the plug shell with respect to the housing member thereby disengaging the first and second portions of the electrical connector.

13. The coupling device according to claim 12 wherein the spring means comprises a compression spring operatively interposed between the plug shell and the housing member,

14. The coupling device according to claim 1 further comprising:

(a) lanyard guide means; and, (b) a lanyard passing through the lanyard guide means and operatively associated with the operating means such that a portion of the lanyard extending between the lanyard guide means and the operating means extends in a substantially axial direction such that any force exerted on the operating means through the lanyard will be in a substantially axial direction.

15. The coupling device according to claim 14 wherein the lanyard guide means comprises a lanyard guide ring fixedly attached to the housing member.

* * * * *